US007023140B2

(12) United States Patent
Yuki et al.

(10) Patent No.: US 7,023,140 B2
(45) Date of Patent: Apr. 4, 2006

(54) ORGANIC EL DISPLAY APPARATUS AND METHOD OF DRIVING THE SAME

(75) Inventors: Toshinao Yuki, Yamagata-ken (JP); Kunihiko Shirahata, Yamagata-ken (JP); Kota Hasebe, Yamagata-ken (JP); Masaki Murakata, Yamagata-ken (JP)

(73) Assignee: Tohoku Pioneer Corporation, Yamagata-ken (JP)

( * ) Notice: Subject to any disclaimer, the term of this patent is extended or adjusted under 35 U.S.C. 154(b) by 0 days.

(21) Appl. No.: 10/992,786

(22) Filed: Nov. 22, 2004

(65) Prior Publication Data

US 2005/0110423 A1 May 26, 2005

(30) Foreign Application Priority Data

Nov. 25, 2003 (JP) ..... 2003-394396

(51) Int. Cl.
*G09G 3/10* (2006.01)

(52) U.S. Cl. ..... 315/169.2; 345/54; 345/96

(58) Field of Classification Search ..... 345/54, 345/95, 96, 76, 77, 206–208, 100, 103, 109; 315/169.1–169.4
See application file for complete search history.

(56) References Cited

U.S. PATENT DOCUMENTS 5,679,472 A * 10/1997 Wu et al. ..... 313/506
5,748,165 A * 5/1998 Kubota et al. ..... 345/96
6,809,481 B1 * 10/2004 Seo et al. ..... 345/76
6,815,891 B1 * 11/2004 Eden et al. ..... 313/618

FOREIGN PATENT DOCUMENTS

JP 11-305727 5/1999

* cited by examiner

*Primary Examiner*—Wilson Lee
(74) *Attorney, Agent, or Firm*—Arent Fox PLLC

(57) ABSTRACT

An organic EL display apparatus which can improve the reliability thereof, by avoiding a leak current which occurs after an operating time, without reducing the product yield. The organic EL display apparatus is comprised of an organic EL panel section, and a driving section which has a reverse voltage restriction unit (means for restricting a reverse voltage) for restricting a reverse voltage which is applied when organic EL devices are not lighted. When a breakdown voltage with respect to a preset thickness $d_o$ of the organic material layer has been $V_b$, the reverse voltage restriction unit will not only set the reverse voltage $V_m$ (to be applied during a non-lighting period) to $V_m<(1/2)\cdot V_b$, but also restrict the continuous applying time of this reverse voltage $V_m$ within a preset period.

8 Claims, 6 Drawing Sheets

ORGANIC EL DISPLAY APPARATUS AND METHOD OF DRIVING THE SAME

BACKGROUND OF THE INVENTION

The present invention relates to an organic EL display apparatus and a method of driving the display apparatus.

The present application claims priority from Japanese Applications No. 2003-394396, the disclosures of which are incorporated herein by reference.

An organic EL (Electroluminescent) display apparatus is a self-light-emission type flat panel display apparatus which attracts a high public attention because it can effectively inhibit its power consumption as compared with a liquid crystal display apparatus using a back light, and also because such an organic EL display apparatus can display a picture with a high brightness. In fact, such an organic EL display apparatus is formed by arranging a plurality of organic EL devices (luminescent devices) in an array of dot matrix, thus making it possible to display a picture by selectively effecting the luminescence of the organic EL devices.

FIG. 1 (conventional technique) shows a fundamental structure and an equivalent circuit for an organic EL device. As shown, an organic EL device 1 comprises a lower electrode 3, an upper electrode 5, and a single-layered or multi-layered organic material layer 4 interposed between the two electrodes, all being mounted on a substrate 2, thereby forming a structure in which the organic material layer 4 containing a luminescent layer is sandwiched between a pair of electrodes (3 and 5), as shown in FIG. 1A. In detail, one of the lower electrode 3 and the upper electrode 5 is used as an anode, while the other is used as a cathode. Once a forward voltage (positive charges (+) are collected on the anode side, while negative charges (−) are collected on the cathode side) is applied between the two electrodes, the electrons injected and transported from the cathode side will re-combined with the holes injected and transported from the anode side, thus effecting a light emission and allowing an electric current to flow from the anode to the cathode. At this time, electric charges are accumulated between the two electrodes until the re-combination is effected. On the other hand, if a reverse voltage (negative charges (−) are applied to the anode side, while positive charges (+) are applied to the cathode side) is applied between the two electrodes, the organic material layer 4 will function as a dielectric layer, and current will not flow between the two electrodes. Therefore, if such an organic EL device 1 is expressed by an equivalent circuit, it can be expressed by a circuit including a diode E and a capacitor C connected in parallel with each other, as shown in FIG. 1B.

When a picture is to be displayed on an organic EL display apparatus including a plurality of such organic EL devices 1 arranged in an array of dot matrix, a forward voltage is applied for a predetermined time period to some organic EL devices 1 selected corresponding to the picture to be displayed, thus allowing an electric current to flow from the anodes to the cathodes of the organic EL devices 1, thereby lighting these organic EL devices 1. Then, when lighting or non-lighting is changed over from each other with the passing of time, a delay will occur in ON-OFF of the current flowing to the organic EL devices due to a time constant of capacitor component, resulting in a phenomenon that brightness are remaining in some organic EL devices even if they should be in a non-lighted state.

In a passive driving type organic EL display apparatus, lower electrodes 3 and upper electrodes 4 are respectively formed into strips and arranged to be orthogonal to one another, thereby forming one organic EL device 1 at each intersection. In this manner, the lower electrodes are used as scanning electrodes while the upper electrodes are used as driving electrodes. Alternatively, the upper electrodes are used as scanning electrodes while the lower electrodes are used as driving electrodes. In displaying, the scanning electrodes are successively selected at a predetermined time interval so as to perform a scanning operation, while the driving electrodes are subjected to voltages corresponding to image signals in synchronism with the scanning operation, thus effecting a driving operation. In this way, the organic EL devices 1 are selectively lighted corresponding to an image to be displayed. However, in such an organic EL display apparatus, since other EL devices are present in the flowing path of an electric current generated when the selected organic EL devices are lighted, there is a problem that a forward current will flow into non-selected organic EL devices 1, hence undesirably resulting in a cross-talk light emission.

To solve the above problem, an organic EL display apparatus has usually adopted an improved driving manner such that a reverse voltage is applied to EL devices not to be lighted, while a forward voltage is applied only to those organic EL devices selected in accordance with image signals. Further, Japanese Unexamined Patent Application Publication No. 11-305727 discloses the above-mentioned passive driving type organic EL display apparatus in which a voltage (which is a reverse voltage) in an opposite direction to a voltage (which is a forward voltage) applied during light emission is applied to all the organic EL devices 1 during a predetermined time period, thereby preventing a poor light emission possibly caused due to a leak current.

According to the above-mentioned patent application publication, if a low resistant thin film portion exists in the organic material layer of the organic EL devices, a reverse voltage to be applied for preventing the above-discussed crosstalk will cause an electric current to flow only into this portion of the organic material layer. As a result, the thin film portion and its surrounding areas of the organic material layer are evaporated so that an expansion pressure occurs which forces the cathodes to be bent in a direction away from the anodes. When such an expansion progress still further, the cathodes will be damaged and this can cause an undesired insulation.

Accordingly, if a thin film portion in which anodes and cathodes are positioned extremely close to each other is present in the organic material layer, an insulation formed by applying a reverse voltage will provide a self-repair function, thereby preventing a short circuit between the anodes and the cathodes in this portion, thus inhibiting the occurrence of a leak current possibly caused by such short circuit.

However, with regard to respective organic EL devices in an organic EL display apparatus, due to various unfavorable factors existing in the manufacturing process, an un-uniformity will be locally present in the organic material layer so that it is impossible to ensure the a fore-mentioned self-repair function (namely, it is impossible to obtain an insulation by a reverse voltage).

On the other hand, since an organic EL display apparatus is required to have an increasingly higher brightness by the market, a forward voltage to be applied when lighting the organic EL devices has become considerably higher. Further, in case of a passive driving type organic EL display apparatus which is required to have a high precision when displaying an image, the light emission brightness of an EL display panel has to be greatly increased in order to deal with a decreased numerical aperture and an increased number of scanning electrode lines. Besides, in response to an increased forward voltage, it is inevitable to have an increased reverse voltage to be applied for eliminating the aforementioned problem caused by the time constant of the capacitor component and another problem caused by the crosstalk light emission.

As to the setting of an applied voltage for an organic EL display apparatus, if the above-mentioned un-uniformity exists in the organic material layer, the organic EL display apparatus can still operate normally at its initial stage of operation without any problem. However, with the passing of a certain time period, it was found that a leak current occurs due to an applied reverse voltage.

Here, it can be considered that the occurrence of the leak current caused due to an un-uniformity in the organic material layer may be avoided by improving a film formation precision of the organic material layer. However, if such an improvement is to be realized, the manufacturing technique at present time will cause a decreased product yield, resulting in an increased manufacturing cost.

SUMMARY OF THE INVENTION

The present invention is to provide an improved organic EL display apparatus with a prerequisite that a reverse voltage is applied to organic EL devices not to be lighted, by investigating a cause of a leak current which occurs after an operation time period has passed, and thus preventing such leak current, thereby improving the reliability of an organic EL display apparatus without causing a deceased product yield.

In order to achieve the above object, the present invention has provided an improved organic EL display apparatus and a method of driving such an organic EL display apparatus, characterized in the following aspects.

Namely, according to one aspect of the present invention, there is provided an organic EL display apparatus in which organic EL devices are arranged in an array of dot matrix on a substrate, and are selectively lighted or not lighted by virtue of a voltage applied in response to image signals, each organic EL device being formed by interposing an organic material layer containing a luminescent layer and having a predetermined thickness $d_o$ between a pair of electrodes. Specifically, the organic EL display apparatus comprises: reverse voltage restriction means for setting a reverse voltage $V_m$ to be applied during a non-lighting period at $V_m < (1/2) \cdot V_b$ and restricting a continuous applying time of the voltage $V_m$ within a preset time, the setting and the restricting being performed when a voltage causing an insulation breakdown on the organic material layer having a thickness $d_o$ has been $V_b$.

Further, according to another aspect of the present invention, there is provided a method of driving an organic EL display apparatus in which organic EL devices are arranged in an array of dot matrix on a substrate, and are selectively lighted or not lighted by virtue of a voltage applied in response to image signals, each organic EL device being formed by interposing an organic material layer containing a luminescent layer and having a predetermined thickness $d_o$ between a pair of electrodes. Specifically, when a voltage causing an insulation breakdown on the organic material layer having a thickness $d_o$ has been $V_b$, a reverse voltage $V_m$ to be applied during a non-lighting period is set at $V_m < (1/2) \cdot V_b$ and a continuous applying time of the voltage $V_m$ is restricted within a preset time.

BRIEF DESCRIPTION OF THE DRAWINGS

These and other objects and advantages of the present invention will become clear from the following description with reference to the accompanying drawings, wherein.

DETAILED DESCRIPTION OF THE PREFERRED EMBODIMENTS

An embodiment of the present invention will be described in the following. The organic EL display apparatus and the method of driving the organic EL display apparatus according to the present embodiment of the present invention are based on an improved organic EL display apparatus with a prerequisite that a reverse voltage is applied to organic EL devices not to be lighted. In fact, it was found that the cause of a leak current which occurs after an operation time period has passed is in the value of an applied reverse voltage as well as in a continuous applying time. Accordingly, the present invention is to restrict such an applied value and such an applying time of such reverse voltage, thereby making it possible to prevent the occurrence of a leak current without requiring a high film formation precision during the manufacturing process.

Figure 1A:
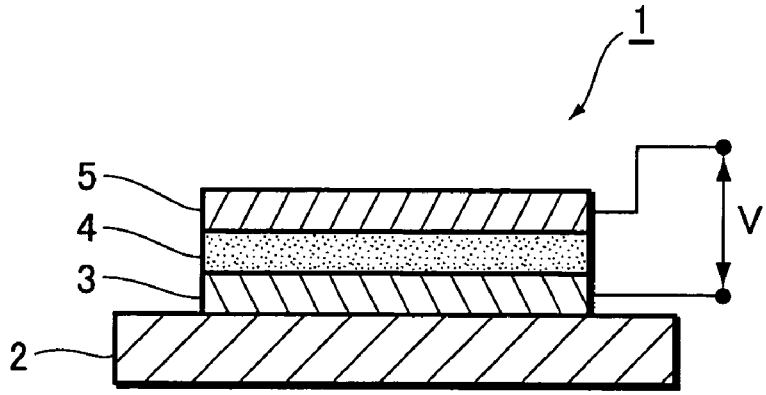
FIG.1 A PRIOR ART
FIGS. 1A and 1B are an explanatory view and a circuit diagram showing a conventional technique.
Figure 1B:
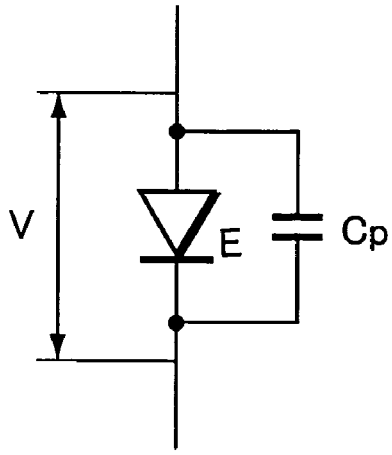

FIG. 2 is an explanatory view showing the organic EL display apparatus and the method of driving the organic EL display apparatus according to the present embodiment of the invention (like portions which are the same as those in the above-described conventional technique are represented by the like reference numerals and repeated description is partially omitted). At first, the mechanism of occurrence of a leak current will be explained with reference to FIGS. 2A to 2C. As shown, in an organic EL device 1 serving as a display unit in an organic EL display apparatus, a reverse voltage $V_m$ is applied between a lower electrode 3 serving as an anode and an upper electrode 5 serving as a cathode. At this time, if there is an un-uniformity in the organic material layer 4, a local portion such as a portion A will exist therein representing a narrow interval between the two electrodes. As a result, once a field strength is higher than a certain value, a weak current $i_p$ will begin to flow through such local portion, as shown in FIG. 1A.

Figure 2A:
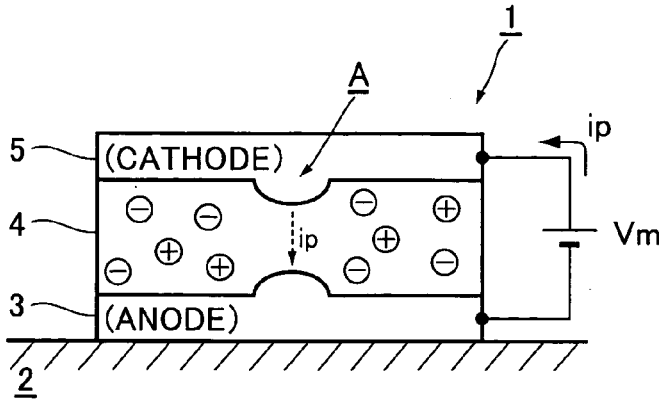
FIGS. 2A to 2D are explanatory views showing a principle of an organic EL display apparatus and its driving method according to an embodiment of the present invention.
Figure 2B:
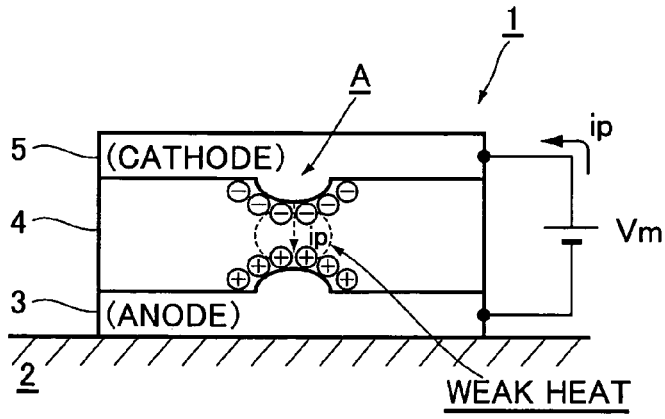
Figure 2C:
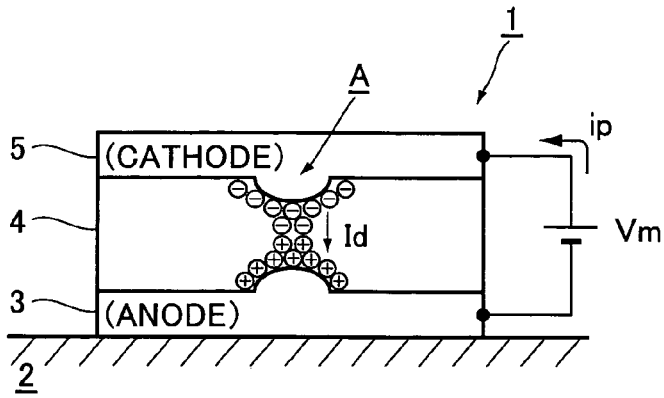

In this manner, once the weak current $i_p$ begins to flow, a weak heat will be generated and this can accelerate the movement of space charges within the organic material layer 4, causing the space charges to be collected in the local portion such as local portion A having a narrow interval between the upper and lower electrodes and having a large field strength, as shown in FIG. 2B. Once the concentration of the space charges becomes higher with the passing of time, a conductive path having a comparatively low resistance will be formed in the concentrated area of space charges, thus increasing a current (leak current) flowing from the cathode side to the anode side. When such state continues, Joule's heat caused by the leak current $i_d$ will increase the temperature of the organic material layer 4 interposed between the upper and lower electrodes, hence causing a short-circuit between the electrodes, as shown in FIG. 2C.

Figure 2D:
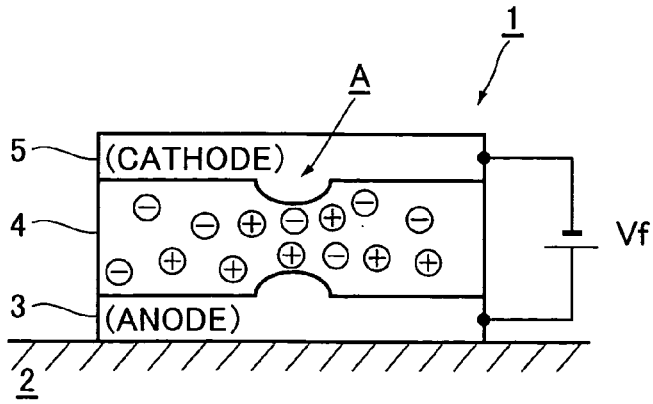

With the understanding of the mechanism of a leak current caused due to a reverse voltage, the inventor of the present invention has found that the occurrence of the leak current $i_d$ can be effectively prevented by diffusing the space charges before the space charges are locally concentrated within the organic material layer 4. Namely, before forming the local concentration of space charges, an applied voltage is reversed from a reverse voltage $V_m$ to a forward voltage $V_f$, so as to promote the diffusion of the space charges, thereby making it possible to avoid the occurrence of the leak current $i_d$, as shown in FIG. 2D.

Moreover, although the organic material layer 4 will function as a dielectric member with respect to a reverse voltage, an energy A expressed in the following equation can be used to judge whether the above-mentioned weak current has begun to flow due to a voltage applied to the dielectric member.

$$A=k\cdot(V/d)^2 \quad (1)$$

A: energy k: inherent constant of material

V: applied voltage d: interval between electrodes (film thickness)

Figure 3:
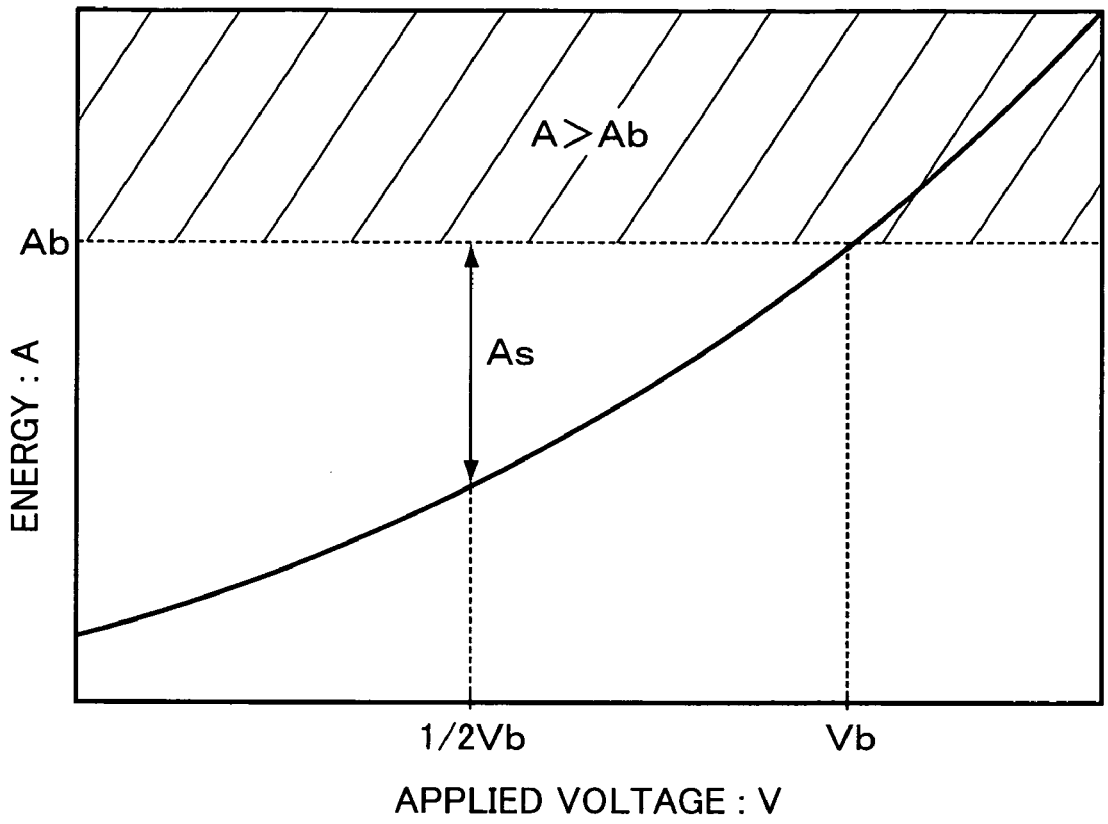
FIG. 3 is an explanatory graph showing a principle of an organic EL display apparatus and its driving method according to an embodiment of the present invention (indicating a relationship between an energy A and an applied voltage V in an organic material layer having a predetermined thickness $d_o$)

FIG. 3 is a graph showing a relationship between an energy A and an applied voltage V on an organic material layer having a thickness $d_o$. Here, $A_b$ represents an energy which generates a weak current in the organic material layer having a thickness $d_o$, $V_b$ represents a reverse voltage (a voltage which causes an insulation breakdown) at this time, while the organic material layer is assumed to have a constant thickness. In this manner, if a reverse voltage $V_m$ is applied within a range of $V_m<V_b$, an energy A will be lower than $A_b$, so that no weak current is generated. On the other hand, if it is assumed that the organic material layer involves an un-uniformity in its thickness, a reverse voltage $V_m$ is necessary to be set sufficiently lower than $V_b$ in accordance with the following equation (2).

$$V_m<(1/2)\cdot V_b \quad (2)$$

In this way, if a reverse voltage $V_m$ is set sufficiently lower than $V_b$ by ensuring a safety margin (energy $A_s$), it is possible to prevent the occurrence of the weak current. Further, if it is required to ensure a higher reliability, $V_m<(1/2)\cdot V_b$ can be changed to $V_m<(1/3)\cdot V_b$, preferably $V_m<(1/4)\cdot V_b$.

Figure 4:
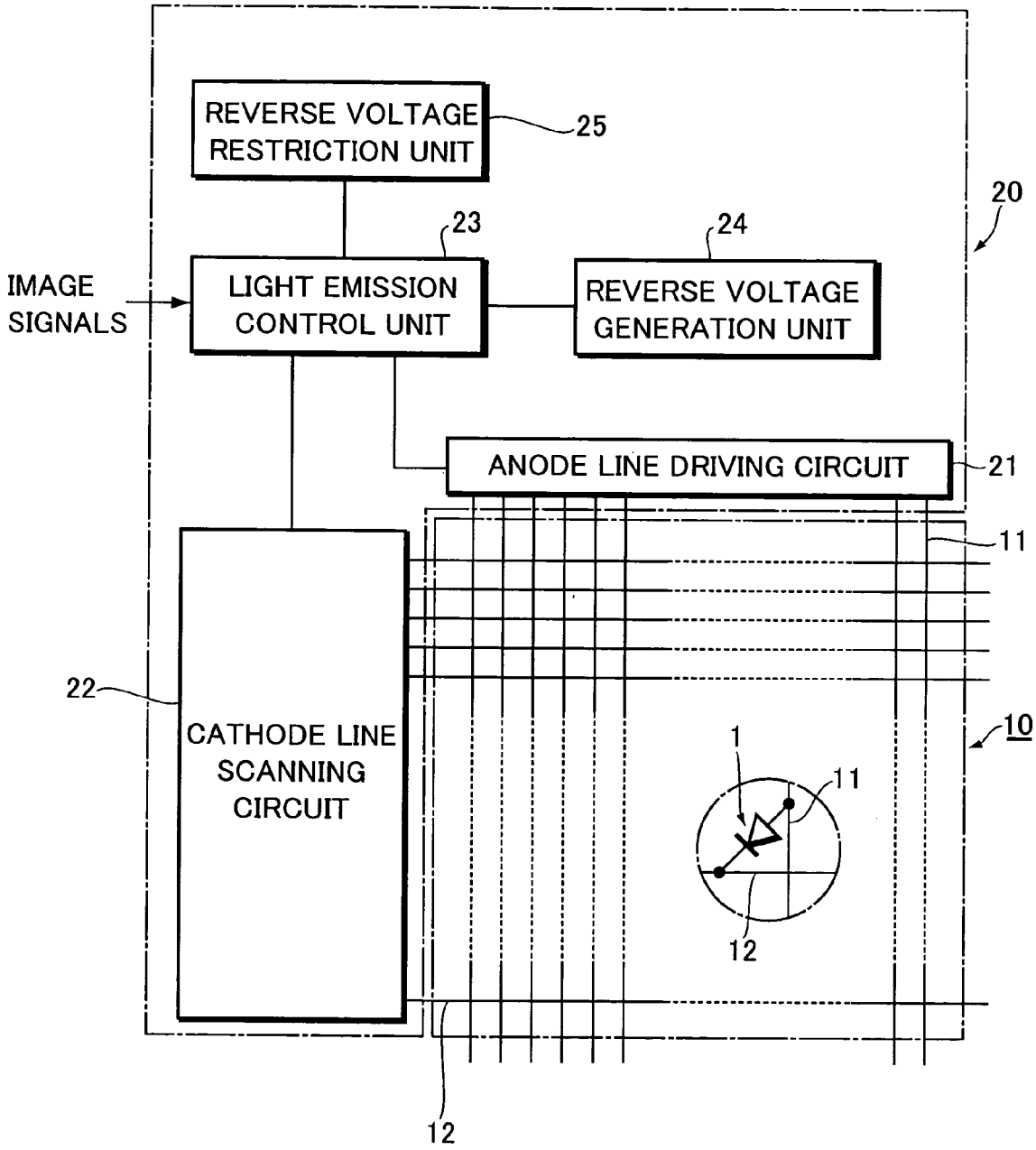
FIG. 4 is an explanatory view showing an organic EL display apparatus according to an embodiment of the present invention.

FIG. 4 is an explanatory view showing an organic EL display apparatus using the above-described principle, according to an embodiment of the present invention. Here, an example used for explaining an organic EL display apparatus is a passive driving type display apparatus comprising an organic EL panel section 10 and a drive section 20.

The organic EL panel section 10 comprises a plurality of organic EL devices 1 arranged in an array of dot matrix and mounted on a substrate, with each organic EL device 1 including a pair of electrodes consisting of an anode and a cathode, and an organic material layer containing a luminescent layer and interposed between the pair of electrodes. The anodes and cathodes are arranged in stripes respectively so as to form anode lines 11 and cathode lines 12 in mutually orthogonal relation, with each intersection forming an organic EL device 1 serving as one displaying unit.

The drive section 20 includes an anode line driving circuit 21 connected with the respective anode lines 11 and a cathode line driving circuit 22 connected with the respective cathode lines 12. The driving section 20 further includes a luminescence control unit 23 for producing control signals based on image signals, a reverse voltage generation unit 24 which generates a reverse voltage to be applied to organic EL devices when they are not lighted, a reverse voltage restriction unit (reverse voltage restriction means) 25 which restricts a reverse voltage to be applied.

Here, the luminescence control section 23 selectively applies a voltage to organic EL devices in response to image signals, and performs a control to light or not to light these organic EL devices. The reverse voltage generation unit 24 generates a reverse voltage to be applied to organic EL devices when they are not lighted, so as to ensure that only selected organic EL devices 1 are clearly lighted.

The reverse voltage restriction unit 25 is provided such that when an insulation breakdown voltage (a voltage that breaks down the insulation of the organic material layer which functions as a dielectric member with respect to a reverse voltage) with respect to the thickness $d_o$ of the organic material layer has been $V_b$, a reverse voltage $V_m$ to be applied during a non-lighting period will be set at $V_m<(1/2)\cdot V_b$ and a continuous applying time of the reverse voltage $V_m$ will be set within a preset time. Here, the insulation breakdown voltage $V_b$ can be found in advance in accordance with a material selected for forming the organic material layer which partially constitutes the organic EL devices 1. On the other hand, the preset time for restricting the continuous applying time can be found by conducting a durability test on the organic EL devices 1 using a preset reverse voltage $V_m$.

Next, an example will be given to explain a method of driving an organic EL display apparatus, based on the function of the above-described reverse voltage restriction unit 25. Namely, a control is performed to light all the organic EL devices 1 mounted on the organic EL panel section 10, with the lighting being effected at least once within the aforementioned preset time. Alternatively, the luminescence control unit 23 is operated to output lighting pattern signals specifying that the respective continuous non-lighting time periods of the organic EL devices 1 are all within the aforementioned preset time. In practice, lighting pattern signals may be such that they can be used alone to indicate lighting patterns, or can be over lapped on image signals before being outputted from the luminescence control unit 23. Furthermore, although various kinds of patterns can be considered for use as lighting patterns, it is effective to employ a pattern in which a linear lighting pattern is displayed as extending across the organic EL panel section 10, and then scrolled in a direction orthogonal to pattern direction.

In this way, even if some organic EL devices 1 not to be lighted in accordance with image signals are continuously maintained at their non-lighted state, the reverse voltage restriction unit 25 can operate to ensure that these organic EL devices are lighted at least once within a preset time, so that it is still possible to avoid the occurrence of a leak current due to a continuous non-lighted state. Moreover, since a reverse voltage $V_m$ is set such that it has a sufficiently lower energy than an energy causing an insulation breakdown (i.e., $V_m$ is set to be sufficiently lower than the breakdown voltage $V_b$), it is possible to exactly prevent the occurrence of a leak current due to an insulation breakdown in a short time period.

[Experiment]

A layer of ITO film having a thickness of 150 nm and for use in forming lower electrodes is formed by sputtering on a glass substrate serving as a substrate. Then, a resist layer (using a photoresist AZ6112 manufactured by TOKYO OHKA KOGYO CO., LTD.) is formed as a stripe-like pattern on the ITO film. Subsequently, the glass substrate is dipped in a mixed liquid containing chloride aqueous solution and hydrochloric acid, so as to etch portions of ITO layer not covered by the resist layer. Meanwhile, the glass substrate is immersed into acetone so as to remove the resist layer, thereby producing a substrate having a predetermined ITO pattern.

Afterwards, the glass substrate carrying the ITO pattern is moved into a vacuum deposition apparatus in which an organic material layer is vapor deposited on the glass substrate. Here, the organic material layer may be formed by including a hole-injection layer consisting of copper phthalocyanine, a hole transporting layer consisting of TDP or the like, a luminescent layer or an electron transporting layer consisting of $Alq_3$ or the like, and an electron injection layer consisting of LiF. Then, an upper electrode layer consisting of Al or the like is laminated on the organic material layer. Specifically, the thickness of the organic material layer (including the hole injection layer, the hole transporting layer, the luminescent layer, the electron transporting layer, and the electron injection layer) is set to be 140 nm, while the thickness of the upper electrode layer is set to be 100 nm.

After the organic EL devices are formed on the glass substrate, a glass sealing cover carrying on its inner surface a desiccating member such as BaO is bonded to the glass substrate through an UV-setting adhesive agent, thereby forming an organic EL panel. In this way, a passive driving type organic EL panel consisting of 96 lines of lower electrodes (anodes)×48 lines of upper electrodes (cathodes) was thus formed. Then, measurement was carried out to measure voltage-current characteristics of the respective EL devices on the organic EL panel, and an electric current occurred when applying a reverse voltage was judged to be a leak current.

(Experiment 1)

Figure 5A:
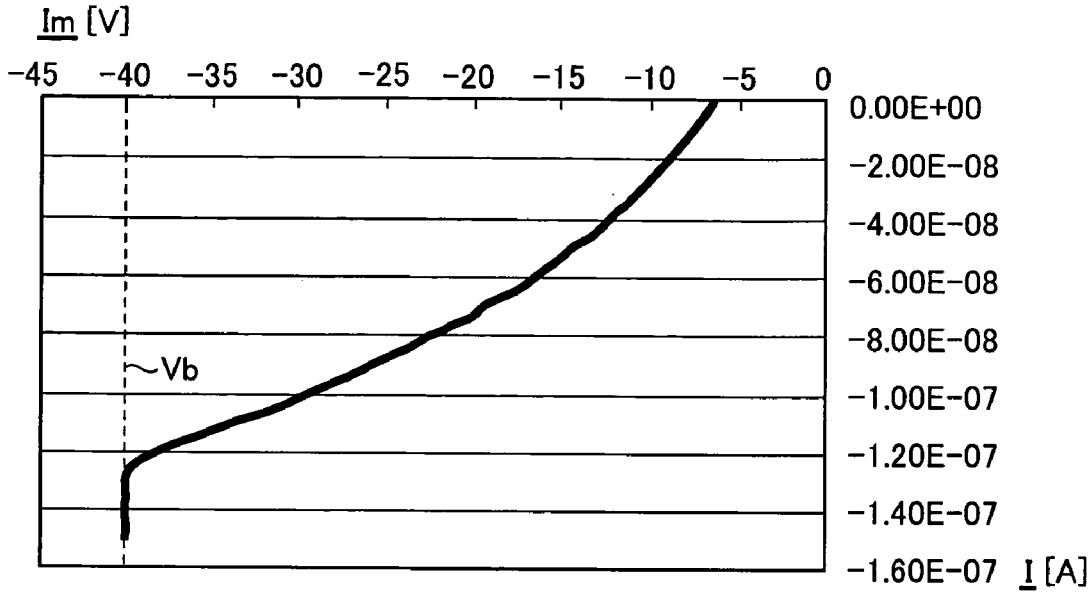
FIGS. 5A and 5B are an explanatory graph and an explanatory view showing an experiment conducted in the present invention.
Figure 5B:
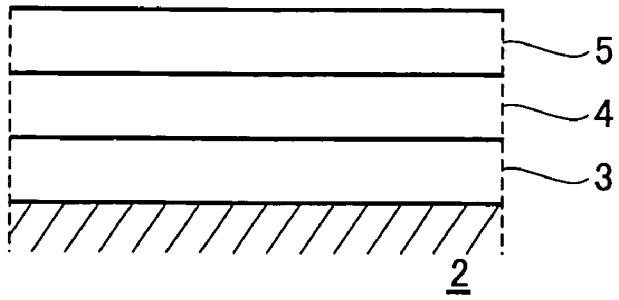
Figure 6A:
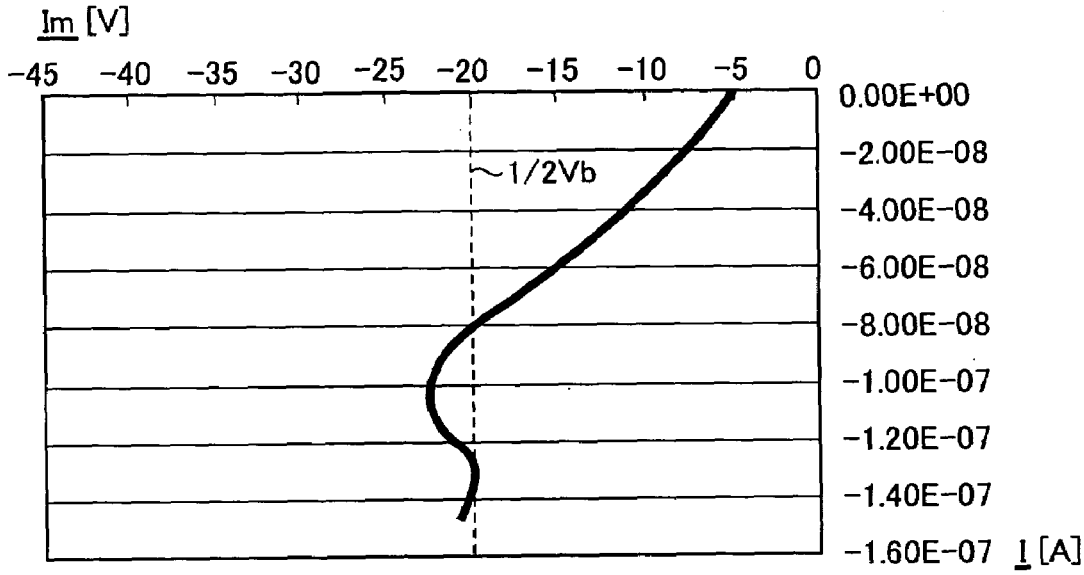
FIGS. 6A and 6B are an explanatory graph and an explanatory view showing an experiment conducted in the present invention.
Figure 6B:
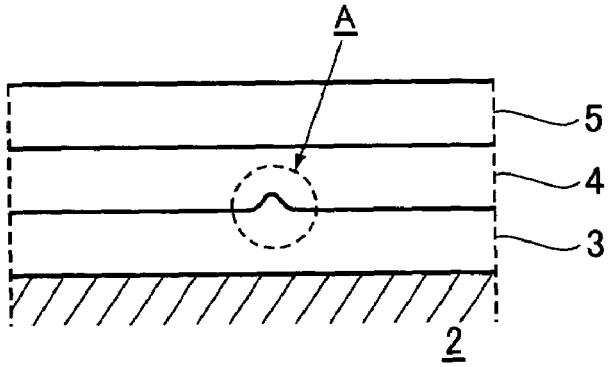

FIG. 5A and FIG. 6A show the measurement results of current values I of the respective pixels (96×48) at the time the brightness of an organic EL panel was set at 80 cd/$m^2$ and the reverse voltage $V_m$ was varied. As shown in FIG. 5A, almost all the pixels are broken down in their insulations by a reverse voltage $V_m$ of −40 [V] (i.e., $V_b$ in the present organic EL panel). In practice, these pixels can be considered as having a uniform film formation state in the organic material layer 4 as shown in FIG. 5B (2: substrate; 3: lower electrode; 5: upper electrode). On the other hand, as shown in FIG. 6A, the insulation of some pixels were broken down by a reverse voltage $V_m$ of −23–−22 [V]. These pixels can be considered to be related to an organic material layer 4 containing a un-uniform portion A as shown in FIG. 6B. When it is assumed that such pixel exists, it is desirable to set $V_m$ at $V_m<(1/2)\cdot Vb$.

(Experiment 2)

A brightness of an organic EL panel was set at 80 cd/$m^2$, a forward voltage $V_f$ was set at 9.7 V, a reverse voltage was set at 9.0 V, one upper electrode line and one lower electrode line of the organic EL panel were lighted while other electrode lines were not lighted. Then, with the passing of time, an observation was carried out to confirm whether leak current has occurred from the non-lighted lines. The observation results are shown in the following Table 1.

TABLE 1

| OPERATION TIME (h) | 0 | 0.5 | 1 | 5 | 15 | 19 | 23 | 47 | 96 |
|---|---|---|---|---|---|---|---|---|---|
| NUMBER OF LEAKS | 0 | 0 | 1 | 1 | 1 | 2 | 3 | 3 | 3 |

The operation was performed for 0 to 96 hours and a leak current occurred when one hour had passed. It was understood that a leak current was generated in non-lighted portions (where the forward voltage is not applied) after one hour or more had passed. From this result it was confirmed that the leak current may be effectively prevented if a preset time for restricting the continuous applying time of $V_m$ is set at 30 minutes.

On the other hand, no leak current was confirmed where all points were lighted or scroll display was performed by virtue of the function of the reverse voltage restriction unit 25 mentioned above.

[Detailed Example of Organic EL Display Apparatus]

a. Electrodes

The lower electrodes are set as cathodes and the upper electrodes are set as anodes, or the upper electrodes are set as cathodes and the lower electrodes are set as anodes. The anodes are formed of a material having a higher work function than the cathodes, which may be a transparent conductive film such as a metal film and a metal oxide film. Here, a metal film may be chromium (Cr), molybdenum (Mo), nickel (Ni), and platinum (Pt) or the like, while a metal oxide film may be ITO, and IZO or the like. On the other hand, cathodes are formed of a material having a lower work function than the anodes, which may be a metal film such as aluminum (Al) and magnesium (Mg) or the like, an amorphous semiconductor such as a doped polyaniline and a doped polyphenylene vinylene or the like, and an oxide such as $Cr_2O_3$, NiO, and $Mn_2O_5$ or the like. Further, where the upper electrodes and the lower electrodes are all formed of transparent materials, it is preferable to provide a reflection film on one side of upper and lower electrodes, opposite to a light emission side.

b. Organic Material Layer

The organic material layer is usually a combination including a hole transporting layer, a luminescent layer, and an electron transporting layer. Actually, each of the hole transporting layer, the luminescent layer, and the electron transporting layer may be not only in the form of one layer but also in the form of several layers. Further, one or both of the hole transporting layer and the electron transporting layer may be omitted. In addition, an organic layer such as a hole injection layer and an electron injection layer may be intercalated if necessary. Practically, the hole transporting layer, the luminescent layer, and the electron transporting layer can be formed by conventional materials (irrespective of whether they are high molecular materials or low molecular materials) in view of their luminescent colors.

Moreover, with regard to a luminescent material forming the luminescent layer, it is allowed to use a material which presents luminescence (fluorescence) at the time of returning from a singlet excited state to a ground state, and it is also possible to use a material which presents luminescence (phosphorescence) at the time of returning from a triplet excited state to a ground state. In fact, according to the present embodiment of the present invention, an organic EL panel may be formed by using either of the above-mentioned two materials.

c. Sealing Cover and Sealing Layer

The organic EL devices are sealed up by a sealing cover which may be made of metal, glass or plastic, or sealed up by a sealing layer. It is possible to use a glass sealing cover having a recess (regardless of a one-step recess or a two-step recess) formed by press molding, etching, blast processing or the like. Alternatively, it is allowed to use a flat glass plate as a sealing cover, which is spaced from the substrate by virtue of spacers made of glass (or plastic), with an internal space formed therebetween.

A sealing layer may be formed by laminating a single protection layer or a plurality of protection layers. In fact, such a sealing layer may be formed of either an inorganic substance or an organic substance. As an inorganic substance, it is allowed to use a nitride such as SiN, AlN, and GaN or the like, an oxide such as SiO, $Al_2O_3$, $Ta_2O_5$, ZnO, and GeO or the like, an oxidized nitride such as SiON or the like, a carbonized nitride such as SiCN or the like, a metal fluorine compound, and a metal film. Further, as an organic substance, it is allowed to use an epoxy resin, an acryl resin, polyparaxylene, a fluorine system macromolecule such as perfluoro olefin and perfluoro ether or the like, a metal alkoxide such as $CH_3OM$ and $C_2H_5OM$ or the like, a polyimide precursor, and a perylene system compound. A laminating manner and a material to be actually used may be properly selected when designing an organic EL panel.

d. Example of Manufacturing Method

At first, ITO or the like is vapor deposited on the substrate made of glass in order to form lower electrodes serving as anodes, or formed into a thin film thereon by means of sputtering or the like, followed by a photolithography processing so as to be formed into a desired pattern. Subsequently, a wet process such as spin coating, dipping, screen printing, and ink jet printing or a dry process such as vapor deposition and laser transfer is carried out to form the organic material layer. In detail, the materials for forming the hole transporting layer, the luminescent layer and the electron transporting layer are successively vapor deposited so that the formed layers are laminated one upon another.

At this time, a mask is used in forming the luminescent layer, and a discriminated painting is performed on the luminescent layer in accordance with a plurality of luminescent colors. During the discriminated painting, an organic material capable of presenting luminescence of three colors (RGB), or a mixture containing several sorts of organic materials is formed into a film and laminated on pixel areas corresponding to RGB. Since such an organic material is formed into a film at least twice in each pixel area, it is exactly possible to avoid the formation of any pixel area not having such an organic material film.

Finally, upper electrodes serving as cathodes are formed as a plurality of metal film strips, in a manner such that the formed upper electrodes are orthogonal to the lower electrodes. In this way, a plurality of organic EL devices are formed at intersections of the upper electrodes with the lower electrodes in an array of dot matrix. In fact, the upper electrodes are formed as thin films by means of vapor deposition or sputtering.

Subsequently, the sealing cover and the substrate are bonded together through an adhesive layer. At this step, an appropriate amount (about 0.1 to 0.5 wt %) of granular spacers (preferably, glass particles or plastic particles) having a diameter of 1 to 300 μm are mixed into an adhesive agent made of an ultraviolet-setting epoxy resin. Then, a dispenser or the like is used to apply the adhesive agent thus prepared to the substrate in positions corresponding to the side walls of the sealing cover. Afterwards, the sealing cover and the substrate are caused to contact each other through the adhesive agent, in an inert gas atmosphere such as argon gas. Subsequently, an ultraviolet light is emitted through the substrate (or the sealing cover) to irradiate the adhesive agent so as to harden the same. In this way, the organic EL devices are sealed up between the sealing cover and the substrate bonded together, with an inert gas such as argon gas sealed therebetween.

e. Various Methods

The present embodiment of the present invention can be varied in its design within a scope not departing from the gist of the invention. For example, apart from the above-described passive driving type, a type of driving an organic EL display panel may also be an active driving type based on TFT. Then, as to an emission type of an organic EL display panel, it is possible to use a bottom emission type display panel in which light is taken from the substrate side, or a top emission type display panel in which light is taken from a side opposite to the substrate.

Further, an organic EL display panel according to the present embodiment of the present invention may be monochromic light emission or multi-color light emission. In order to realize a multi-color light emission, it is of course possible to perform the above-described discriminated painting, but also possible to employ CF method or CCM method in which a color filter or a color conversion layer based on a fluorescent material is combined into a monochromic (such as a white color or a blue color) luminescent functional layer, a photo breeching method which permits light emission of several colors by applying an electromagnetic wave to the luminescent area of a monochromatic luminescent functional layer, or SOLED (transparent Stacked OLED) method in which two or more colors of sub-pixels are vertically laminated to form one pixel.

In this way, according to the above-discussed embodiment of the present invention, there is provided an improved organic EL display apparatus with a prerequisite that a reverse voltage is applied to non-lighted organic EL devices, making it possible to effectively prevent a leak current which will otherwise occur after an operation time, without having to increase the film formation precision for organic EL devices. Therefore, it is possible to improve the reliability of an organic EL display apparatus without reducing the product yield.

While there has been described what are at present considered to be preferred embodiments of the present invention, it will be understood that various modifications may be made thereto, and it is intended that the appended claims cover all such modifications as fall within the true spirit and scope of the invention.

What is claimed is:

1. An organic EL display apparatus in which organic EL devices are arranged in an array of dot matrix above a substrate, and are selectively lighted or not lighted by virtue of a voltage applied in response to image signals, each organic EL device being formed by interposing an organic material layer containing a luminescent layer and having a predetermined thickness $d_o$ between a pair of electrodes, said organic EL display apparatus comprising:

reverse voltage restriction means for setting a reverse voltage $V_m$ to be applied during a non-lighting period at $V_m<(1/2)\cdot V_b$ and restricting a continuous applying time of the voltage $V_m$ within a preset time, said setting and said restricting being performed when a voltage causing an insulation breakdown on the organic material layer having a thickness $d_o$ has been $V_b$.

2. The organic EL display apparatus according to claim 1, wherein said preset time is within 30 minutes.

3. The organic EL display apparatus according to claim 1 or 2, wherein the reverse voltage restriction means operates to light all the organic EL devices at least once during said preset time.

4. The organic EL display apparatus according to claim 1 or 2, wherein the reverse voltage restriction means operates to display a lighting pattern effecting that the respective continuous non-lighting time periods of the organic EL devices are within said preset time.

5. A method of driving an organic EL display apparatus in which organic EL devices are arranged in an array of dot matrix on a substrate, and are selectively lighted or not lighted by virtue of a voltage applied in response to image signals, each organic EL device being formed by interposing an organic material layer containing a luminescent layer and having a predetermined thickness $d_o$ between a pair of electrodes, wherein when a voltage causing an insulation breakdown on the organic material layer having a thickness $d_o$ has been $V_b$, a reverse voltage $V_m$ to be applied during a non-lighting period is set at $V_m<(1/2)\cdot V_b$ and a continuous applying time of the voltage $V_m$ is restricted within a preset time.

6. The method according to claim 5, wherein said preset time is restricted within 30 minutes.

7. The method according to claim 5 or 6, wherein all the organic EL devices are lighted at least once during said preset time.

8. The method according to claim 5 or 6, wherein a lighting pattern is displayed which effects that the respective continuous non-lighting time periods of the organic EL devices are within said preset time.

* * * * *